US010309605B2

(12) United States Patent
Schragl et al.

(10) Patent No.: US 10,309,605 B2
(45) Date of Patent: Jun. 4, 2019

(54) ILLUMINATION APPARATUS FOR A MOTOR VEHICLE

(71) Applicant: ZKW Group GmbH, Wieselburg (AT)

(72) Inventors: Martin Schragl, Zarnsdorf (AT); Christian Bemmer, Klein-Poechlarn (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 15/529,575

(22) PCT Filed: Nov. 12, 2015

(86) PCT No.: PCT/AT2015/050288
§ 371 (c)(1),
(2) Date: May 25, 2017

(87) PCT Pub. No.: WO2016/081967
PCT Pub. Date: Jun. 2, 2016

(65) Prior Publication Data

US 2017/0314754 A1 Nov. 2, 2017

(30) Foreign Application Priority Data

Nov. 26, 2014 (AT) ..... A 50854/2014

(51) Int. Cl.
*F21S 41/14* (2018.01)
*F21S 41/16* (2018.01)
(Continued)

(52) U.S. Cl.
CPC ..... *F21S 41/285* (2018.01); *F21S 41/13* (2018.01); *F21S 41/14* (2018.01); *F21S 41/16* (2018.01); *F21S 41/37* (2018.01); *F21S 41/40* (2018.01)

(58) Field of Classification Search
CPC .... F21S 48/1225; F21S 48/14; F21S 48/1145; F21S 48/1394; F21S 41/37; F21S 41/40; F21S 41/285
See application file for complete search history.

(56) References Cited

U.S. PATENT DOCUMENTS 3,043,709 A * 7/1962 Amborski ..... B29C 70/58 252/589
6,488,394 B1 * 12/2002 Mabe ..... B05D 7/53 362/510

(Continued)

*Primary Examiner* — Alexander K Garlen
*Assistant Examiner* — Colin J Cattanach
(74) *Attorney, Agent, or Firm* — Eversheds Sutherland (US) LLP

(57) ABSTRACT

The invention relates to an illumination apparatus (100), especially for a motor vehicle, comprising at least one laser light source (10); a wavelength conversion element (20) that is designed to receive excitation light from the at least one laser light source (10); and a reflector (30) having at least one reflector body (30'), which at least one reflector body (30') comprises a reflecting surface (31), which reflecting surface (31) reflects the light emitted by the wave-length conversion element (20) in the visible wavelength range, wherein the reflector (30), at its reflector surface (30*a*) bearing the reflecting surface (31), is provided with the reflecting surface (31), wherein the reflector surface (30*a*) has at least one region (30*a'*, 30*a''*) that is free of the reflecting surface (31), and wherein the reflector surface (30*a*), at least in the region (30*a'*, 30*a''*) that is free of the reflecting surface (31), is embodied such that at least some of the excitation light incident in the region (30*a'*, 30*a''*) is absorbed.

14 Claims, 3 Drawing Sheets

(51) Int. Cl.

| | |
|---|---|
| ***F21S 41/20*** | (2018.01) |
| ***F21S 41/37*** | (2018.01) |
| ***F21S 41/40*** | (2018.01) |
| ***F21S 41/13*** | (2018.01) |

(56) References Cited

U.S. PATENT DOCUMENTS

| | | | | |
|---|---|---|---|---|
| 8,702,286 | B2 * | 4/2014 | Nakazato | F21S 41/14 362/510 |
| 2011/0279007 | A1 * | 11/2011 | Kishimoto | B60Q 1/0011 313/45 |
| 2012/0140501 | A1 * | 6/2012 | Nakazato | F21S 41/14 362/510 |
| 2016/0102828 | A1 * | 4/2016 | Ahn | F21S 48/13 362/510 |
| 2017/0122516 | A1 * | 5/2017 | Hager | F21S 48/1145 |

* cited by examiner

ILLUMINATION APPARATUS FOR A MOTOR VEHICLE

The invention relates to an illumination apparatus, especially for a motor vehicle, comprising:

at least one laser light source;

a wavelength conversion element that is designed to receive excitation light from the at least one laser light source;

and a reflector having at least one reflector body, which at least one reflector body comprises a reflecting surface, which reflecting surface reflects the light emitted by the wavelength conversion element in the visible wavelength range, wherein the reflector, at its reflector surface bearing the reflecting surface, is provided with the reflecting surface.

The invention furthermore relates to a motor vehicle headlight having such an illumination apparatus and to a motor vehicle having such an illumination apparatus and having at least one such motor vehicle headlight.

Laser light sources (e.g. semiconductor lasers, laser diodes) have a number of special, advantageous properties, such as e.g. high radiation intensities and a small light-emitting surface. In addition, the emitted light bundles are largely collimated.

Because of this, there are numerous advantages associated with the use of laser light sources for illumination purposes, e.g. optical systems in which a laser light source is used as the light source may be realized with smaller focal lengths and more highly bundled beam paths. This is not possible with less strongly collimated light bundles (for instance of incandescent bulbs or light-emitting diodes (LEDs)). Thus when using laser light sources it is possible to create optical systems for laser light with limited installation space.

As a rule, lasers emit monochromatic light or light in a narrow wavelength range. However, in a motor vehicle headlight, white mixed light is desirable or legally prescribed for the emitted light so that laser light sources cannot be used in a motor vehicle headlight with nothing further.

In addition, when using laser light sources there is the problem that the latter may be dangerous, especially for the human eye. This is because lasers normally emit coherent and strongly collimated light, which is potentially dangerous at the typical high radiation intensities of laser light sources. This is especially true for radiant powers of a few watts, as are desired in the field of motor vehicle illumination.

Therefore safety instructions for operating laser devices must be assured in order to be able to employ laser light sources in the field of motor vehicles, especially motor vehicle headlights. In particular it must be assured that light (laser light) only exits from a motor vehicle headlight at an intensity below the prescribed limits. In addition, glare to or endangering of motorists must be prevented.

In addition, there must also be compliance with safety requirements if the illumination apparatus is deformed or miscalibrated, for instance due to mechanical influences, during an accident, or due to an error in assembly. Even in these cases it must be assured that the illumination apparatus and the motor vehicle headlight comply with the safety instructions for operating laser systems.

Frequently so-called conversion elements (also called wavelength conversion elements in this text) are used in conjunction with white light-emitting diodes (LEDs) or luminescence conversion LEDs for converting monochromatic light to white or polychromatic light. Such a conversion element is embodied e.g. in the form of a photoluminescent converter or comprises at least one a photoluminescent converter or at least one photoluminescent element. As a rule they have a photoluminescent dye.

The light of an LED that generally emits colored (e.g. blue) light (also called "excitation light") excites the photoluminescent dye, causing photoluminescence, whereupon the photoluminescent dye itself emits light of other wavelengths (e.g. yellow). In this manner it is possible to convert a portion of the emitted light of one wavelength range to light of another wavelength range. As a rule another portion of the emitted light (excitation light) is scattered and/or reflected by the photoluminescent element. The scattered and/or reflected light and the light emitted by photoluminescence then overlay one another in an additive manner and lead, e.g. to white mixed light. Depending on the life span of the excited state, the mechanism of photoluminescence may be differentiated into fluorescence (short life span) and phosphorescence (long life span).

Conversion elements are categorized as reflective conversion elements and transmissive conversion elements. In reflective conversion elements, the light converted by the conversion element is emitted on the same side on which the excitation light is incident on the conversion element. In transmissive conversion elements, the converted light is emitted from the side that faces away from the side on which the excitation light is incident.

When using conversion elements in motor vehicle headlights in connection with a laser light source, the conversion element is very important with respect to safety. If the position of the conversion element is changed or if the conversion element is destroyed (e.g. by mechanical influences, accident, production error, or design error), highly bundled laser beams may exit from the motor vehicle headlight.

It is an object of the present invention to configure an illumination apparatus as described above for motor vehicles, wherein the illumination apparatus has at least one laser light source, such that the danger from excitation light emitted by the laser light source is prevented to the greatest extent possible and the illumination apparatus complies with prescribed safety requirements, for instance statutory requirements.

This object is attained with an illumination apparatus as described above in that according to the invention the reflector surface has at least one region that is free of the reflecting surface, and wherein the reflector surface, at least in the region that is free of the reflecting surface, is embodied such that at least some of the excitation light incident in the region is absorbed.

By providing on the reflector surface at least one region that absorbs at least some of the excitation light from the laser light source that is incident on this region, if there is a fault no excitation light at all, or only weakened excitation light, escapes via the reflector into the exterior of the illumination apparatus.

Preferably an absorbing region is to be arranged on the reflector or on the reflecting surface of the reflector such that the absorbing region is disposed in the region that where the excitation light from the laser light source would be incident if, for instance, the conversion element decalibrates, is porous, or is omitted altogether, or it is provided that an absorbing surface is disposed in a region in which excitation light is emitted by the conversion element.

In principle, the at least one region that absorbs at least some excitation light may be formed from any desired material, it must merely be ensured that sufficient excitation light therefrom is absorbed if there is a fault. The absorbing region is preferably adapted specifically for each system, i.e.

adapted to the intensity of the light source that emits excitation light, to the focusing of the spot, etc. With a low-power light source it may be sufficient e.g. to use the absorption of a non-vapor-deposited and non-blackened plastic (in this regard, see the explanation further below regarding this exemplary embodiment); with higher-power light sources it may still be necessary to blacken the region left free to obtain sufficiently absorbent properties.

The absorbing region is made of e.g. polycarbonate ("PC", e.g. Makrolon, Apec, etc.), PBT (polybutylene terephthalate), or ABS (acrylonitrile butadiene styrene). In addition, the absorbing region may also be embodied colored black to increase the absorption.

It may be provided that the reflector surface is coated with a reflecting material that forms the reflecting surface. With such a reflector, it may then be provided that, in the at least one region that is free of the reflecting surface, the reflector surface is not coated with the reflecting material or, after coating, the reflecting material is removed in the at least one region so that at least some incident excitation light is absorbed on the reflector surface.

For instance, in this case the reflector body may be made of a material described above (for example, PC, ABS, PBT), so that in the region in which the reflecting surface is "omitted," at least the excitation light may be absorbed on the reflector surface of the reflector body.

In the region in question (the region that is to absorb the excitation light), the reflecting surface (reflecting surface) is rendered free of reflecting material, e.g. by means of a surface coating process (e.g. vapor deposition, chromium coating, sputtering, etc. of the reflector surface) by means e.g. of lasering out or uncovering or unmasking, so that a surface that absorbs excitation light is formed on this/these processed region(s).

Essentially independent of how the reflector is produced, it may also be provided that the reflector body has at least one through-hole, and wherein the at least one through-hole is closed with a closure element, wherein the surface of the closure element, which surface is disposed on the side of the reflecting surface, forms the region that absorbs at least some of the excitation light.

"Essentially" independent of how the reflector is produced means that the embodiment described above may in principle be employed in reflectors produced in any manner, but that there may be production methods that may preferred.

Two or more excitation light-absorbing regions may also be provided in one reflector, wherein they may be realized in manners different from that described above.

It is preferably provided in the latter embodiment that the surface of the closure element closes the entire the through-hole so that there cannot be any regions of optical disturbance between the closure element and the reflector.

It is of particular advantage when the closure element is embodied and/or is inserted into the through-hole such that the surface transitions essentially continuously to the reflecting surface.

In this manner it is possible to ensure that there will be no disadvantageous optical effects in the transition area between the surface of the through-opening and the reflecting surface (e.g.

scattering of the excitation light and/or of the mixed light).

In the embodiment in which the reflector surface is provided with the reflecting surface, wherein one or a plurality of regions are free of, or are rendered free of, the reflecting surface, in typical production processes the reflecting surface is thin such that even when a region is kept free or rendered free, there is a de facto continuous transition with respect to light.

Regardless of the embodiment of the excitation light-absorbing region, it is advantageous when the at least one excitation light-absorbing region is embodied such that most or all of the excitation light is absorbed.

Most of the excitation light being absorbed means that at least 70% of the incident excitation light is absorbed. The degree of absorption is preferably at least 90%, even more preferably 99%, especially 99.99%.

In one embodiment of an absorbing region it is provided that an absorbing region is embodied resistant to temperature. When the incident light, especially excitation light, is absorbed, this region heats up; the resistance to temperature assures that the region will not deform or melt.

In another embodiment of an absorbing region it is provided that said at least one absorbing region is embodied non-temperature resistant above a certain limit temperature. This limit temperature is, for instance, 120° C.

The limit temperature is, for instance, a melting temperature, above which the material of the absorbing region begins to melt. The limit temperature may also be a decomposition temperature at which the material begins to decompose.

The temperature resistance of the material of the absorbing area depends, for instance, on the color of the material, which color may be influenced by the addition of additives (for example carbon black particles, to obtain a black material), to a granulate from which the absorbing region is produce, e.g. by means of injection molding.

If the absorbent area heats up beyond the limit temperature, the absorbing region is destroyed in that it melts or burns, and the excitation light may then travel into the rear portion of the illumination apparatus, where it is lost and thus poses no danger.

As was mentioned in the foregoing, it is in particular advantageous when an excitation light-absorbing region is arranged in or on the reflector surface such that excitation light from the laser light source directly incident on the reflector surface and/or excitation light that is emitted by the conversion element is incident on the absorbing region.

In this way in particular when there is a problem with the conversion element, for instance if the latter is porous or has been destroyed or decalibrated, it is possible to ensure that the excitation light travels onto the absorbing region and, at least some of this excitation light is absorbed, preferably most of it is absorbed, and in particular all of it is absorbed.

It may be advantageous when an absorbing region is arranged, and is embodied with respect to its surface extension, such that all of the excitation light directly from the laser light source and incident on the reflector surface and/or all of the excitation light that is emitted by the conversion element is incident on the absorbing region.

In this case, at least some of the excitation light that is emitted by the conversion element onto the reflector and could be reflected outward by the reflecting surface is absorbed, preferably most of it is absorbed, and in particular all of it is absorbed.

In addition, two or more absorbing regions may be provided that are either all the same type of absorbing region, or at least one absorbing region is of the first type described in the foregoing and at least one absorbing region is of the second type described in the foregoing. The characterization "type" relates to the arrangement of the absorbing region in terms of the laser light source and the conversion element.

It is particularly preferred when one absorbing region is arranged, and is embodied with respect to its surface extension, such that all of the excitation light incident on the reflector surface directly from the laser light source and/or all of the excitation light that is emitted by the conversion element is incident exactly and only on the absorbing region.

In this way all of the excitation light travels onto the absorbing region, with the absorbing region being minimal in size.

In principle materials used for the excitation light-absorbing region are preferably thermosetting plastics or elastomers, wherein elastomers prove advantageous in particular in connection with the closure element, i.e. the closure element is formed from the elastomer. In contrast to thermoplastics, which are also suitable in principle, thermosetting plastics have the advantage that they are decompose (burn) above a certain limit temperature (decomposition temperature), so they never melt uncontrollably as a liquid plastic. Provided they are not thermoplastic elastomers, the properties of elastomers are as good as those of thermosetting plastics.

The absorbing properties of the absorbing region also result, for instance, from the dark, especially black, coloration of the specific material in the absorbing region.

The invention shall be explained in greater detail in the following using the drawings.

Figure 1:
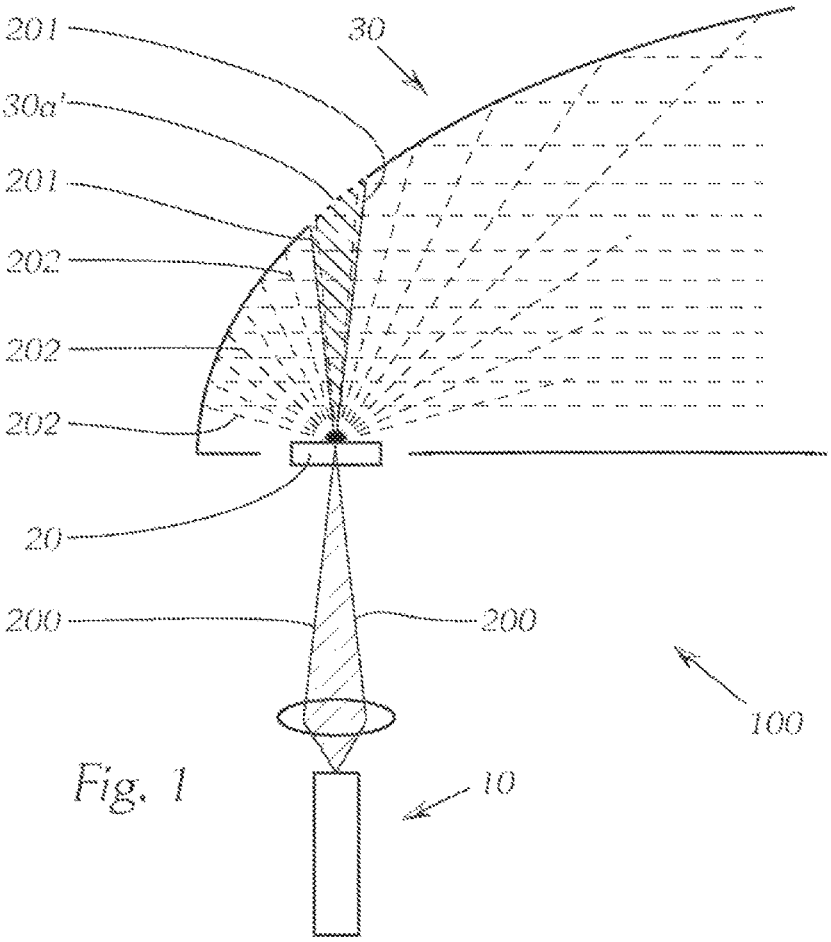
FIG. 1 is a schematic depiction of a first embodiment of an inventive illumination apparatus.

FIG. 1 depicts an illumination apparatus 100 comprising a laser light source 10, a conversion element 10, and a reflector 30. The laser light source 10 emits excitation light 200 ("primary light") that is incident on the conversion element 20, is converted by the latter to e.g. white mixed light 202 in the manner described in the foregoing, is emitted by the conversion element 20 onto the reflector 30, and is emitted by the latter into the exterior for forming a light distribution.

The light distribution that may be produced with the illumination apparatus is for instance a low beam distribution; a high beam distribution; part of a low beam or high beam distribution; cornering, adaptive, freeway, fog, inclement weather, or blinker light distribution, etc.; or one or more parts of the foregoing.

Figure 2:
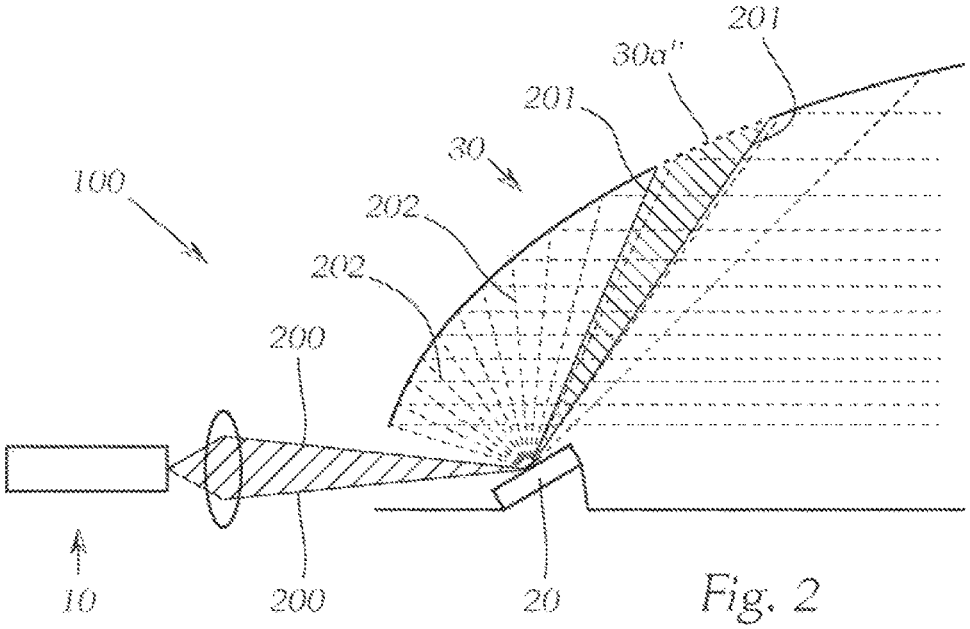
FIG. 2 is a schematic depiction of a second embodiment of an inventive illumination apparatus.

FIG. 2 also depicts an illumination apparatus 100; the statements made in the foregoing apply to it in the same way, as well.

The difference between the illumination apparatus 100 in FIGS. 1 and 2 is found in the type of conversion element 20 and the arrangement resulting therefrom.

The illumination apparatus 100 according to FIG. 1 has a transmissive conversion element 20 that radiates mixed light 202 at least on its side/surface facing away from the laser light source 10. In principle light may be radiated in all directions by the conversion element, and, e.g., optical apparatus that are upstream of the conversion element and that act like a filter may be employed to be able to use the converted light that is reflected back in this manner, but the further optical system is disposed on the side/surface facing away from the laser light source.

Excitation light 200 that is incident on the conversion element 20 is primarily incident on the reflector 30 in the beam cone 201, especially if there is a fault as described above. Therefore an excitation light-absorbing region 30*a*' is provided on the reflector 30 in a region of the reflector on which the excitation light cone 201 is incident (more precisely, the sectional surface between the reflector surface and the cone 201) so that excitation light 201 that is incident on the reflector is absorbed.

The illumination apparatus 100 according to FIG. 2 has a reflective conversion element 20 that emits mixed light 202 on its side/surface facing the laser light source 10. Excitation light 200 that is incident on the conversion element 20 is primarily reflected onto the reflector 30 in the beam cone 201, especially if there is a fault as described above. Therefore an excitation light-absorbing region 30*a*" is provided on the reflector 30 in a region of the reflector on which the excitation light cone 201 is incident (more precisely, the sectional surface between the reflector surface and the cone 201) so that excitation light 201 that is incident on the reflector is absorbed.

FIG. 2 provides only a schematic depiction of the conversion element. Frequently the latter is arranged on a support or comprises a support that is preferably embodied as reflecting so that the mixed light is emitted with a higher yield. If there is a fault, e.g. if the conversion element drops from the support, however, the safety risk increases substantially due to reflection of the laser beam on the reflecting support. This risk may be reduced significantly with the inventive embodiment as described above.

Different embodiments of an absorbing region 30*a*', 30*a*" on the specific reflector 30 are discussed in the following using the two illumination apparatus 100 from FIG. 1 and FIG. 2. It should be noted that the embodiment of the absorbing region of the illumination apparatus 100 from FIG. 1 could be implemented in exactly the same manner for the illumination apparatus from FIG. 2 instead of the absorbing region 30*a*" illustrated there, and, likewise, the absorbing region 30*a*" described in detail in the following according to the illumination in FIG. 2 may also be embodied or implemented in the reflector from FIG. 1 instead of the absorbing region 30*a*' illustrated there. Furthermore, it is also possible for an illumination apparatus as depicted in the two figures to have two or more absorbing regions for excitation light. The absorbing regions may be embodied identically, but differently realized absorbing regions, as depicted in the following, may also be implemented together in one illumination apparatus.

Figure 3:
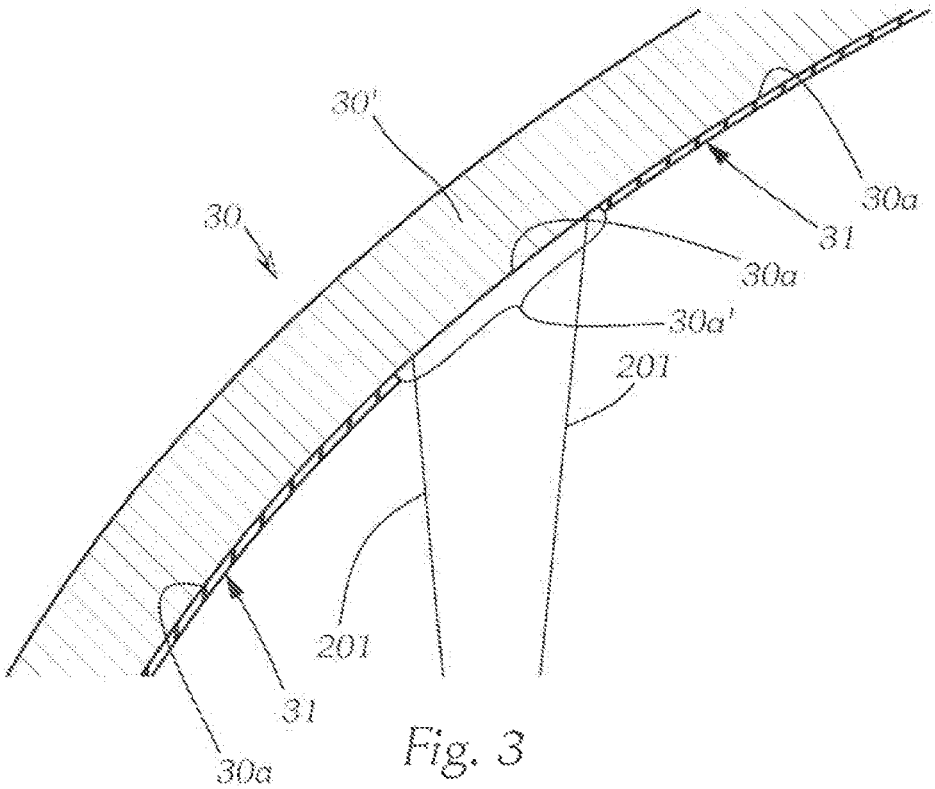
FIG. 3 depicts an enlarged excerpt from FIG. 1 in the area of the absorbing region.

FIG. 3 illustrates a detail from FIG. 1. A segment of the reflector 30 is depicted, wherein this reflector 30 comprises a reflector body 30', and wherein this reflector body 30' comprises or has a reflecting surface 31 that reflects the light or mixed light that was produced by the wavelength conversion element 20 and is in the visible wavelength range. As already explained using FIG. 1, this reflected light later produces a light distribution in the exterior upstream of the illumination apparatus.

The reflecting surface 31 is applied to one side of the reflector 30, specifically the so-called reflector surface 30*a* of the reflector body 30'. For instance, the reflector surface 30*a* may be coated with the reflecting surface 31, as shall be explained in greater detail in the following. The reflecting surface 31 is formed from a light-reflecting material in order to be able to reflect light that is in the visible wavelength range as just described in the foregoing.

According to the invention, the reflector surface 30*a* has a region that is free of the reflecting surface 31. This free region represents an excitation light-absorbing region 30*a*' that absorbs at least some, preferably most, or even, advantageously, all of the excitation light incident there-on. The excitation light-absorbing region 30*a*' that is free of the reflecting surface 31 may be produced such that, when the reflector surface 30*a* is treated, e.g. coated, the latter is not provided the reflecting material, e.g. is not coated, in the desired region, for instance the region may be masked or otherwise covered prior to the reflecting material being applied so that no material that forms the reflecting surface 31 reaches this region. However, it is also possible for the entire reflector surface 30*a* to be provided with the reflecting material first, for instance to be coated, and then for the reflecting surface 31 to be removed again in the desired region that is to be absorbing, at least for the excitation light.

The absorbing region 30*a*' is thus formed from the "base material" forming the reflector body 30', which base material comprises a light-absorbing material, especially the material that absorbs the excitation light. This base material is formed from e.g. PEI (polyetherimide) or PC (polycarbonate) or contains one of these materials, which have a high temperature resistance.

Figure 4:
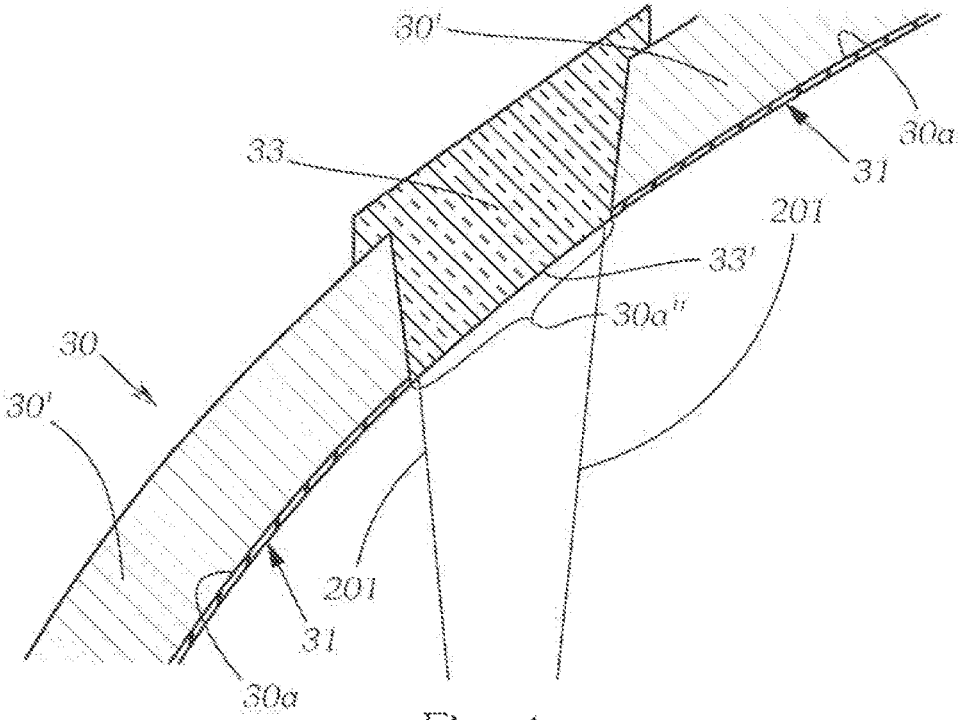
FIG. 4 depicts an enlarged excerpt from FIG. 2 in the area of the absorbing region formed by a closure element; and, FIG. 4*a* depicts the excerpt from FIG. 4 prior to the closure element being inserted into the reflector.
Figure 4A:
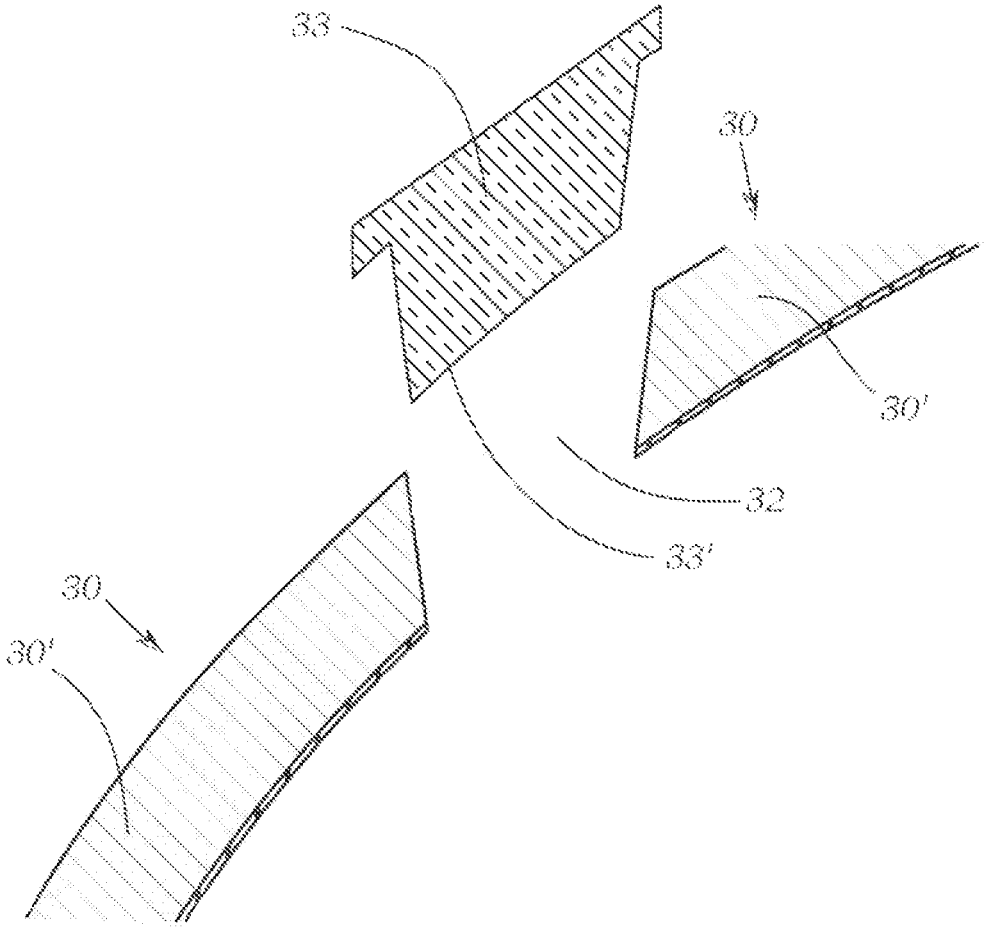

FIG. 4 and FIG. 4*a* provide a detail view of a reflector 30 from FIG. 2. In the embodiment illustrated, the reflector 30 again has a reflector body 30', wherein the reflector body 30' is provided with a reflecting surface 31. In the embodiment illustrated, the reflector 30 as shown in FIG. 1 thus again comprises the reflector body 30', which has a reflector surface 30*a* to which the reflecting surface 31 is applied, for instance by coating. But in this embodiment it may also be provided that, for instance, the entire reflector 30 is already formed from a reflecting material, that is, that reflector body 30' and reflecting surface 31 are embodied in one piece. In this case there is no terminological distinction between reflector surface and reflecting surface.

Regardless of the specific manner in which the reflector 30 is embodied (see previous paragraph), in the embodiment illustrated according to 2 and FIGS. 4, 4*a* it is provided that the reflector 30 or reflector body 30' has a through-hole 32, wherein this through-hole 32 may be closed with a closure element 33. The surface 33' of the closure element 33, which when the closure element 33 is inserted is disposed on the side of the reflecting surface 31, forms at least some of the excitation light-absorbing region 30*a*", preferably most of it or all of it. As is depicted in FIG. 4, it is preferable for the closure element 33 to be embodied such that, when inserted, the surface 33' of the closure element 33 completely closes the through-hole 32. In particular it is advantageous when the surface 33' of the closure element 33 essentially connects in a continuous manner to the reflecting surface 31.

The closure element 33 is preferably made of an absorbing material (such as was already mentioned, e.g. polycarbonate, PBT, or ABS). Using the closure element 33, the through-hole 32 is preferably covered from the back or external side of the reflector body 30' or preferably closed as described above by inserting the closure element 33, adapted appropriately to the through-hole 32, into the through-hole 32 as described in the foregoing.

The closure element 33 may be made of an absorbing material that is resistant to increased temperature due to the emitted laser light (excitation light), so that the laser light is absorbed and does not leave the illumination apparatus. But it is also possible to use absorbing material that is not resistant to increased temperature due to the laser light. In this case, the laser light is first absorbed at an absorbing region 30*a*" until a certain limit temperature is reached (e.g. 120° C.) and the closure element 33 melts or burns. Laser light then travels through the open through-hole 32 and is lost in the rear portion of the illumination apparatus.

The absorbing region may also be produced by means of a multi-component injection molding method. The absorbing region may be a) produced from an absorbing material that is resistant to the increase in temperature due to the laser light or b) embodied from an absorbing material that is not, however, resistant to the temperature increase but has the qualities described in the foregoing.

An injection molding processes is best suited for producing a reflector in connection with the present invention. In principle it is also possible to use a pressure casting method, especially in combination with an injection molding method, (e.g. a reflector body with an opening could be produced in the pressure casting method and the closure element could be produced with the injection molding method).

An embodiment according to FIG. 4 prevents laser light from being able to exit from the headlight, or reduces the risk thereof, in the event of a fault.

In an injection molding process, during the production of a reflector body with an opening a so-called "joint line" is created due to the method; in some cases it may be unwanted for esthetic reasons. In addition, there may disadvantageously be scatter light in the region of the limit of the opening.

The problem of the joint line is also solved with the variant according to FIG. 3 (removing or not applying the reflecting coating). Since no opening has to be produced in the reflector body, no joint line can be created, either. As a rule the coating is very thin, typically in the neighborhood of 140 nm, so that the transition or step between coated region and uncoated region is irrelevant in terms of light; therefore no disadvantageous scatter light can occur there, either.

With sufficiently precise production, such disadvantageous scatter light does not occur in an embodiment according to FIG. 4 in the region between the opening and closure element, either.

The invention claimed is:

1. An illumination apparatus (100) for a motor vehicle, the illumination apparatus comprising:

at least one laser light source (10);

a wavelength conversion element (20) configured to receive excitation light from the at least one laser light source (10); and a reflector (30) having at least one reflector body (30'), wherein the at least one reflector body (30') comprises a reflecting surface (31), wherein the reflecting surface (31) is configured to reflect visible light emitted by the wavelength conversion element (20), and wherein the reflecting surface (31) is provided on a reflector surface (30*a*) of the at least one reflector body (30'), wherein the reflector surface (30*a*) has at least one region (30*a*', 30*a*") that is free of the reflecting surface (31), and wherein the at least one region (30*a*', 30*a*") that is free of the reflecting surface (31) is configured to absorb at least some of the excitation light incident in the at least one region (30*a*', 30*a*"), wherein the at least one region (30*a*', 30*a*") is non-temperature resistant above a limit temperature, and wherein above the certain limit temperature the at least one absorbing region is destroyed and the excitation light travels into a rear portion of the illumination apparatus.

2. The illumination apparatus of claim 1, wherein the reflector surface (30*a*) is coated with a reflecting material that forms the reflecting surface (31).

3. The illumination apparatus of claim 2, wherein in the at least one region (30*a*') that is free of the reflecting surface (31), the reflector surface (30*a*) is not coated with the reflecting material or, after coating, the reflecting material is removed in the at least one region (30*a*') so that at least some incident excitation light is absorbed by the reflector surface.

4. The illumination apparatus of claim 1, wherein the at least one reflector body (30') has at least one through-hole (32), and wherein the at least one through-hole (32) is closed with a closure element (33), wherein a surface (33') of the closure element (33) that is disposed on a side of the reflecting surface (31) forms the at least one region (30*a*") that absorbs at least some of the excitation light.

5. The illumination apparatus of claim 4, wherein the surface (33') of the closure element (33) closes the entire at least one through-hole (32).

6. The illumination apparatus of claim 4, wherein the closure element (33) is embodied and/or is inserted into the at least one through-hole (32) such that the surface (33') transitions essentially continuously to the reflecting surface (31).

7. The illumination apparatus of claim 1, wherein the at least one region (30*a*', 30*a*") is embodied such that most or all of the excitation light is absorbed.

8. The illumination apparatus of claim 1, wherein the limit temperature is 120° C.

9. The illumination apparatus of claim 1, wherein the at least one region (30*a*', 30*a*") is arranged in or on the reflector surface (30*a*) such that excitation light from the laser light (10) source directly incident on the reflector surface and/or excitation light that is emitted by the conversion element (20) is incident on the at least one region (30*a*, 30*a*").

10. The illumination apparatus of claim 9, wherein the at least one region (30*a*', 30*a*") is arranged with respect to its surface extension, such that all of the excitation light directly from the laser light source (10) and incident on the reflector surface and/or all of the excitation light that is emitted by the conversion element (20) is incident on the at least one region (30*a*', 30*a*").

11. The illumination apparatus of claim 10, wherein the at least one region (30*a*', 30*a*") is arranged with respect to its surface extension, such that all of the excitation light incident on the reflector surface directly from the laser light source (10) and/or all of the excitation light that is emitted by the conversion element (20) is incident exactly and only on the at least one region (30*a*', 30*a*").

12. A motor vehicle headlight having at least one illumination apparatus according to claim 1.

13. A motor vehicle having at least one illumination apparatus according to claim 1.

14. An illumination apparatus (100) for a motor vehicle, the illumination apparatus comprising:

at least one laser light source (10);

a wavelength conversion element (20) configured to receive excitation light from the at least one laser light source (10); and a reflector (30) having at least one reflector body (30'), wherein the at least one reflector body (30') comprises a reflecting surface (31), wherein the reflecting surface (31) is configured to reflect visible light emitted by the wavelength conversion element (20), and wherein the reflecting surface (31) is provided on a reflector surface (30*a*) of the at least one reflector body (30'), wherein the reflector surface (30*a*) has at least one region (30*a*', 30*a*") that is free of the reflecting surface (31), and wherein the at least one region (30*a*', 30*a*") that is free of the reflecting surface (31) is configured to absorb at least some of the excitation light incident in the at least one region (30*a*', 30*a*"), wherein the at least one region (30*a*', 30*a*") is non-temperature resistant above 120° C., and wherein above 120° C., the at least one absorbing region is destroyed, thereby to permit the excitation light to travel into a rear portion of the illumination apparatus.

* * * * *